US005733692A

United States Patent [19]

Nagase et al.

[11] Patent Number: 5,733,692

[45] Date of Patent: Mar. 31, 1998

[54] TONER KIT FOR ELECTROPHOTOGRAPHY

[75] Inventors: Tatsuya Nagase; Tomoyasu Umeno; Ryuji Kitani; Meizo Shirose, all of Hachioji, Japan

[73] Assignee: Konica Corporation, Japan

[21] Appl. No.: 828,254

[22] Filed: Mar. 26, 1997

[30] Foreign Application Priority Data

Mar. 29, 1996 [JP] Japan ..... 8-076559

[51] Int. Cl.[6] ..... G03G 13/01; G03G 9/09

[52] U.S. Cl. ..... 430/45; 430/106; 430/110; 430/111

[58] Field of Search ..... 430/45, 106, 110, 430/111

[56] References Cited

U.S. PATENT DOCUMENTS

| | | | |
|---|---|---|---|
| 5,229,242 | 7/1993 | Mahabadi et al. | 430/110 |
| 5,314,778 | 5/1994 | Smith et al. | 430/111 |
| 5,368,970 | 11/1994 | Grushkin | 430/110 |
| 5,486,445 | 1/1996 | Van Dusen et al. | 430/110 |
| 5,516,612 | 5/1996 | Vianco et al. | 430/106 |
| 5,518,850 | 5/1996 | Bayley et al. | 430/109 |

*Primary Examiner*—Roland Martin
*Attorney, Agent, or Firm*—Jordan B. Bierman; Bierman, Muserlian and Lucas LLP

[57] ABSTRACT

Disclosed is a toner kit for an electrophotography, comprising a black toner and a first toner whose color is other than black, wherein said first toner has a first softening point $T_1$, said first toner comprises a first releasing agent, a first intermolecular crosslinked polyester resin having a second softening point $T_2$ of 100° C. to 150° C., obtained by a reaction of an alcohol having at least two hydroxyl group and an aromatic carboxylic acid having at least two carboxyl group and a processed pigment having a third softening point $T_3$ of 100° C. to 150° C., said processed pigment comprising a pigment and a resin in which said pigment is dispersed, and said resin forms domain structure in said first polyester resin, and wherein said black toner has a fourth softening point $T_4$, said black toner comprises a second releasing agent, a colorant and a second intermolecular crosslinked polyester resin having a fifth softening point $T_5$ of 100° C. to 150° C., obtained by a reaction of an alcohol having at least two hydroxyl group and an aromatic carboxylic acid having at least two carboxyl group, and wherein said fourth softening point $T_4$ is not less than said first softening point $T_1$.

17 Claims, 1 Drawing Sheet

EGUIVALENT DIAMETER ( FERET DIAMETER )

TONER KIT FOR ELECTROPHOTOGRAPHY

FIELD OF THE INVENTION

The present invention relates to a toner kit for electrophotography, more specifically a toner kit for electrophotography comprising a black toner and at least one toner whose color is other than black.

BACKGROUND OF THE INVENTION

Regarding a toner kit for electrophotography, properties necessary for colored toners composed of a yellow toner, a magenta toner and a cyan toner are different from those necessary for a black toner. Especially, for images for overhead projectors (hereinafter referred to as OHP), the transparency is necessary for the colored toners, while the opacifying property is necessary for the black toner.

The colored toners, when employed to generate the images for OHP, are required to result in the color images with high transparency. The transparency can be obtained by making the image surface flat. In order to obtain the more flat surface, it is necessary to lower a softening point of the toners. However, when the softening point is lowered, offsetting is caused due to the lowered softening point.

On the other hand, when the black toner has composition similar to that of the colored toners, high gloss is caused at fixing images and resulting documents become unsuitable for reading because of glittering images.

Japanese Patent Publication Open to Public Inspection No. 63-300254 describes the following relationship of toner storage elastic modulus G' with tangent loss tan δ. The tan δ at G' (16 Hz)=$10^5$ dyn/cm$^2$ satisfies the relationship of colored toner tan δ>black toner tan δ. However, the examples only illustrate the toner design related to glossy images and are different from the present invention in the design concept on the toners for non-glossy images. In addition, no description is made on polyester resins with intermolecular crosslinked structures and processed pigments.

Japanese Patent Application Open to Public inspection No. 3-185459 discloses "Toners comprising binder resins, polyolefin waxes and processed pigments wherein said processed pigments are prepared by kneading the pigments and processing resins similar to the binder resins". It is found that because of the large difference in the softening point between the binder resin and the processed pigments, no homogeneous mixing is made to cause the instability of the dispersion of the pigments.

Japanese Patent Application Open to Public Inspection No. 2-66561 describes "Colored toners wherein processed pigments which are prepared by melt blending the pigments and resins are dispersed into binder resins, and the weight average molecular weight of the resins for processing the pigments is less than that of the binder resins and the weight average molecular weight of the binder resins is 100,000 or more". However, in domain structures for the combination of non-compatibility of the binder resins with the resins for processing the pigments, no size of the resins that form domains is specified. In addition, no technical concept is included for the improvement in the transparency of colored toners for images for OHP.

Japanese Patent Application Open to Public Inspection No. 3-107869 discloses "Colored toners comprising polyester binder resins together with a master batch prepared by kneading pigments with polystyrene or styrene-acrylic resins. However, no domain sizes are specified for the styrene-acrylic resins which form phase separation structures in the toners. When no appropriate domain sizes are secured, offsetting and poor transparency of images for OHP are caused.

Japanese Patent Publication Open to Public inspection No. 7-219274 discloses "Colored toners containing polyolefin waxes wherein pigment-dispersing resins are obtained by mixing water-containing pigment paste with a pigment-dispersing resin solution while heating, and a SP value ($SP_b$) of binding resins and a SP value ($SP_a$) of said pigment-dispersing resins satisfy a relationship of $0.5 \leqq |Sp_b - SP_a| \leqq 1.5$". However, no domain sizes are described for styrene-acrylic resins. It is impossible to control the domain sizes only by the specifications of the SP values. Here, the SP represents a solubility parameter.

As mentioned above, with use of the conventional technology, it has been difficult to provide a toner kit for electrophotography which can prepare excellent color images as a result of meeting requirements both for the transparency necessary for colored toners and opacifying property necessary for the black toner and furthermore, causes no offsetting.

SUMMARY OF THE INVENTION

Accordingly, an object of the present invention is to provide a toner kit for electrophotography which can prepare excellent color images by enabling the coexistence of the transparency necessary for the colored toners and opacifying property necessary for the black toner, and in addition, no formation of offsetting.

The above-described object of the present invention has been achieved by the following embodiments.

Item 1. A toner kit for an electrophotography, comprising a black toner and a first toner whose color is other than black, wherein said first toner has a first softening point $T_1$, said first toner comprises a first releasing agent, a first intermolecular crosslinked polyester resin having a second softening point $T_2$ of 100° C. to 150° C. obtained by a reaction of an alcohol having at least two hydroxyl group and a carboxylic acid having at least two carboxyl group and a processed pigment having a third softening point $T_3$ of 100° C. to 150° C., said processed pigment comprising a pigment and a binder resin in which said pigment is dispersed, and said binder resin forms domain structure in said first polyester resin, and wherein said black toner has a fourth softening point $T_4$, said black toner comprises a second releasing agent, a colorant and a second intermolecular crosslinked polyester resin having a fifth softening point $T_5$ of 100° C. to 150° C., obtained by a reaction of an alcohol having at least two hydroxyl group and a carboxylic acid having at least two carboxyl group, and wherein said fourth softening point $T_4$ is not less than said first softening point $T_1$.

Item 2. The toner kit of item 1, wherein said binder resin is a styrene-acrylic resin.

Item 3. The toner kit of item 1, wherein said domain structure has a domain size of 0.5 to 2.0 μm in said first polyester resin.

Item 4. The toner kit of item 1, wherein said $T_2$ and said $T_3$ satisfy the following Formula 1:

Formula 1

$|T_2 - T_3| \leqq 10°$ C.

Item 5. The toner kit of item 1, wherein said toner other than said black toner and said black toner each has a volume average particle size of 1 to 30 μm.

Item 6. The toner kit of item 1, wherein said first toner and said black toner each has a volume average particle size of 5 to 15 μm.

Item 7. The toner kit of item 1, wherein said pigment is contained in an amount of not less than 30% and of less than 50% by weight of said binder resin.

Item 8. The toner kit of item 2, wherein said styrene-acrylic resin has a weight average molecular weight (Mw) of 10,000 to 40,000, a number average molecular weight (Mn) of 4,000 to 20,000 and a ratio of said weight average molecular weight (Mw) to said number average molecular weight (Mn) is not more than 5.

Item 9. The toner kit of item 1, wherein said colorant is a carbon black.

Item 10. The toner kit of item 1, wherein said colorant is selected from carbon black group consisting of Channel Black, Firmness Black, Acetylene Black, Thermal Black and Lamp Black.

Item 11. The toner kit of item 1, wherein said second releasing agent is a low molecular weight polyethylene having a number average molecular weight of 1,500 to 10,000.

Item 12. The toner kit of item 1, wherein said second releasing agent is a low molecular weight polyethylene having a number average molecular weight of 1,500 to 6,000.

Item 13. The toner kit of item 1, wherein at least one of said black toner and said toner other than said black toner contains inorganic fine particles selected from a group consisting of silica, titanium oxide, aluminum oxide, barium titanate and strontium titanate.

Item 14. The toner kit of item 13, wherein said inorganic fine particles have a hydrophobicity of 10 to 90 in terms of methanol wetability.

Item 15. The toner kit of item 13, wherein said inorganic fine particles have a hydrophobicity of 30 to 80 in terms of methanol wetability.

Item 16. A toner image forming method, comprising steps of:

(1) forming a first latent image on an image carrying member, (2) developing said first latent image with a first toner whose color is other than black, (3) forming a second latent image on an image carrying member, and (3) developing said second latent image with a black toner, wherein said first toner has a first softening point $T_1$, said first toner comprises a first releasing agent, a first intermolecular crosslinked polyester resin having a second softening point $T_2$ of 100° C. to 150° C. obtained by a reaction of an alcohol having at least two hydroxyl group and a carboxylic acid having at least two carboxyl group and a processed pigment having a third softening point $T_3$ of 100° C. to 150° C., said processed pigment comprising a pigment and a binder resin in which said pigment is dispersed, and said binder resin forms domain structure in said first polyester resin, and wherein said black toner has a fourth softening point $T_4$, said black toner comprises a second releasing agent, a colorant and a second intermolecular crosslinked polyester resin having a fifth softening point $T_5$ of 100° C. to 150° C. obtained by a reaction of an alcohol having at least two hydroxyl group and a carboxylic acid having at least two carboxyl group, and wherein said fourth softening point $T_4$ is not less than said first softening point $T_1$.

Item 17. The toner image forming method of item 16, wherein said first toner is a toner selected from the group consisting of a yellow toner, a magenta toner and a cyan toner.

DETAILED DESCRIPTION OF THE INVENTION

Figure 1:
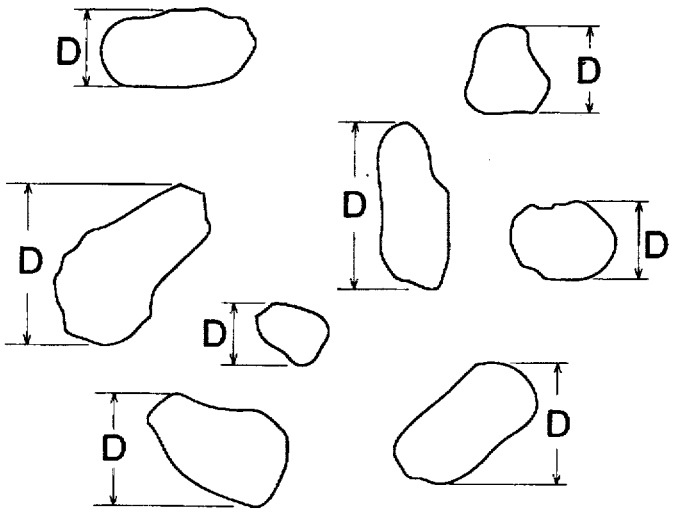
FIG. 1 is a Feret diameter of a domain.

The toner kit for electrophotography of the present invention has enabled excellent color images through the coexistence of the transparency necessary for the colored toners and the opacifying property necessary for the black toner, while making the compositions of the colored toners different from that of the black toner.

When the colored toners are applied to generate images for OHP, the desired transparency is accomplished by making the image surface flat. In order to make the surface more flat, it is necessary to lower the softening point. The formation of offsetting due to the lowered softening point has been prevented by the improvement in wettability for rollers through replacing partially the surface of the toners with the styrene-acrylic resins. This has enabled the color images with better transparency.

If the black toner has the same composition as that of the colored toners, resulting images become so glossy at fixing that the documents with glittering images are not suitable for reading. Accordingly, it is preferable that the black toner results in images with low gloss. Then, the softening point of the black toner is specified to be higher than that of the colored toners. When fixed under the same conditions, the gloss of the black toner is decreased as compared to that of the colored toners and the resulting images become suitable for reading.

Accordingly, the softening point of the colored toners has been designed to be lower than that of the black toner, while aiming at making the toner surface flat, and the offsetting which may be caused due to the above design has been prevented by adding to the toners the styrene-acryl resins which have poor affinity with PFA resins employed as surface materials of fixing rollers. The object of the present invention is achieved by using the black toner with the higher softening point than that of the colored toners and no styrene-acryl resins, since the flatness of the toner surfaces at fixing is out of the question.

(1) Compositions of Developer

Toners of the present invention are mixed toners of inorganic fine particles with colored particles comprising polyester resins with crosslinked structures as main components, processed pigments as colorants for the colored toners which are prepared by dispersing the pigments to the styrene-acrylic resins or carbon blacks as colorants for the black toner, and releasing agents and other additives as required. The average particle size of each toner is usually 1 to 30 μm in terms of the volume average particle size and preferably 5 to 15 μm. Resins composing the colored particles are polyester resins which are synthesized using carboxylic acids having at least two carboxyl group and dihydric polyhydric alcohols.

The polyester resins are prepared by the condensation-polymerization of carboxlyic acids having at least two carboxyl group with dihydric or polyhydric alcohols. Illustrative examples of the carboxylic acids having at least two carboxyl group and dihydric or polyhydric alcohols used for the synthesis of the polyester resins of the present invention are described below.

<<Aromatic Carboxylic Acids>>

Aromatic carboxylic acids having at least two carboxyl group include phthalic acid, isophthalic acid, terephthalic acid, 1,2,4-benzenetricarboxylic acid, 2,5,7-naphthalenetricarboxlyic acid, 1,2,4-naphthalenetricarboxylic acid, pyromellitic acid and the like. In addition, anhydrides of these acids can be employed.

<<Other Carboxylic Acids having at least two Carboxyl Group>>

There are illustrated maleic acid, fumaric acid, citraconic acid, iraconic acid, glutaconic acid, succinic acid, adipic acid, sebacic acid, azelaic acid, malonic acid, n-dodecylsuccinic acid, n-dodecenylsuccinic acid, isododecylsuccinic acid, isododecenylsuccinic acid, n-octylsuccinic acid, n-octenylsuccinic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricaroxlyic acid, tetra(methylenecarboxyl)methane, 1,2,7,8-octanetetracarboxylic acid, empol trimer acid and the like. Anhydrides of these acids can be used.

<<Polyhydric Aromatic Alcohols>>

There are illustrated etherificated bisphenols such as polyoxypropylene(2.2)-2,2-bis(4'-hydroxyphenyl)propane, polyoxypropylene(3.3)-2,2-bis(4'-hydroxyphenyl)propane, polyoxyethylene(2.0)-2,2-bis(4'-hydroxyphenyl)propane, polyoxypropylene(2.0)-polyoxyethylene(2.0)-2,2-bis(4'-hydroryphenyl)propane, polyoxypropylene(6)-2,2-bis(4'-hydroxyphenyl)propane, etc., bisphenol A, bisphenol Z, 1,3,5-trihydroxymethylbenzene and the like.

<<Polyhydric Alcohols>>

There can be illustrated ethylene glycol, diethylene glycol, triethylene glycol, 1,2-propylene glycol, 1,3-propylene glycol, 1,4-butanediol, 1,4-butenediol, neopentyl glycol, 1,5-pentane glycol, 1,6-hexane glycol, 1,4-cyclohexanedimethanol, dipropylene glycol, polyethylene glycol, polypropylene glycol, polytetramethylene glycol, hydrogenated bisphenol A, sorbitol, 1,2,3,6-hexanetetrol, 1,4-sorbitan, pentaerythritol, dipentaerythritol, tripentaerythritol, 1,2,4-butanetriol, 1,2,5-pentatriol, glycerol, 2-methylpropanetriol, 2-methyl-1,2,4-butanetriol, trimethylolethane, trimethylolpropane and the like.

A ratio of acids to alcohols can be preferably used in the range of 1:0.95 to 1:1.05. A content amount of the trihydric or polyhydric components depends on the degree of crosslinking and the addition amount is adjusted to obtain the desired degree of the crosslinking. Generally speaking, a preferred addition amount for the trihydric or polyhydric components is 15 mole percent or lower and the softening point of the resins thus obtained is adjusted to from 100° to 150° C. The softening point of the resins and the processed pigments described below are measured with the following method. A Flowtester CFT-500 (Shimazu Corporation) is used. The grain sizes of samples are classified in advance to 9.2 mesh-pass (sieve opening of 2.0 mm) and 32 mesh-on (sieve opening of 0.5 mm). Then, the sample grains are molded to a circular cylindrical shape with a height of 10 mm. While heating it at a rate of 6° C. per minute, a load of 20 kg/cm$^2$ is given from the plunger, and the nozzle with a diameter of 1 mm and a length of 1 mm is pushed out. By this operation, a curve (softening fluid curve) showing the plunger descending amount versus temperature is obtained. When the height of the S shaped curve is h, the softening point of the present invention is defined as the temperature corresponding to h/2.

It is preferable that pigments for the colored toners are the processed pigments that are prepared by dispersing the pigments into the styrene-acrylic resins. As the pigments used in the present invention, yellow pigments, magenta pigments and cyan pigments are illustrated. As the yellow pigments, benzidine yellow pigments are preferable. The benzidine yellow pigments are yellow organic pigments of 3,3'-dichlorobenzidine derivatives. illustrative examples include, as representatives, C. I. Pigment Yellow Nos. 12, 13, 14, 15, 17, 55, 83, 174 (C. I. Nos. 21090, 21100, 21095, 21105) and the like. As the magenta pigments, are illustrated quinacridone magenta pigments such as 2,9-dimethylquinacridone, C. I. Pigment Red 122, azo lake magenta pigments such as C. I. Pigment Red No. 57-1 and the like. As the cyan pigments, copper phthalocyanine pigments are preferable. Illustrative examples include C. I. Pigment Blue Nos. 15, 15-3, 15-4, 15'-6 and halogenated phthalocyanines and the like. The number average primary particle sizes to a great extent in accordance with pigment kinds and is preferably in the range of about 10 to about 200 nm. These pigments are, in advance, dispersed into the styrene-acrylic resins. Illustrative components for the styrene-acrylic resins include styrene or styrene derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene or p-n-dodecylstyrene, methacrylate derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, dimethylaminoethyl methacrylate, etc., acrylate derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, dimetylaminoethyl acrylate, diethylaminoethyl acrylate, etc., vinyl esters such as vinyl propionate, vinyl acetate, vinyl benzoate, etc., vinyl ethers such as vinyl methylether, vinyl ethylether, etc., vinyl ketones such as vinyl methylketone, vinyl ethylketone, vinyl hexylketone, etc., N-vinyl compounds such as N-vinyl carbazole, N-vinyl indole, N-vinyl pyrrolidone, etc., vinyl compounds such as vinyl naphthalene, vinyl pyridine, etc., and acrylic acid or methacrylic acid derivatives such as acrylonitrile, methacrylonitrile, acrylamide, N-butylacrylamide, N,N-dibutylacrylamide, methacrylamide, N-butylmethacrylamide, N-octadecylacrylamide, etc.

Illustrative polymerization initiators employed for synthesis of the resins include peroxides such as benzoyl peroxide, lauryl peroxide, etc. and azo compounds such as azobisisobutyronitrile, azobisisovaleronitrile, etc. A preferred addition amount of the initiators is from 0.1 to 2 weight percent of the monomer. When the addition amount is much less than the above range, no polymerization proceeds to a full extent and the remaining monomer itself causes problems. When the addition amount is much more than the above range, the decomposed substances of polymerization initiators remain which affect the triboelectrification property. In addition, the polymerization reaction proceeds so rapidly resulting in the decreasing of molecular weight. The resins can be prepared by any of an emulsion polymerization method, a suspension polymerization method and a solution polymerization method.

Dispersion of the pigments to the styrene-acrylic resins can be performed by using technologies well known in the art. For example, there are illustrated methods wherein pigment particles and resins together with disperse agents, if necessary are melt blended by a high-speed shearing machine having rollers and kneaders, and water paste of the pigments and resins are melt blended followed by transferring the pigments into the water phase to the resin phase then, removing water and the like. However, methods are not limited thereto. The concentration of the pigments is an important parameter that affects the degree of the dispersion of the pigments into the resins. When the concentration of the pigments in the styrene-acrylic resins is less than 30 weight percent, the pigment dispersion is good but the cost tends to be high due to the dispersion processing. It is preferable that the concentration of the pigments is 30 weight percent or more and less than 50 weight percent from a standpoint of the pigment dispersion and cost. When the concentration of the pigments is 50 weight percent or more, the pigments in the styrene-acrylic resins tend to recoagulate.

The adjustment of molecular weight of the resins and concentration of the pigments enables the softening point of the processed pigments to enter the range of 100° to 150° C. Generally speaking, the softening point of the pigments processed with the resins becomes higher than that of the resins due to the inclusion of the pigments. Under the concentration of the pigments of 30 weight percent or more and less than 50 weight percent, in order to enable the softening point to the range of 100° to 150° C., it is required that when the molecular weight of the styrene-acrylic resins is measured by GPC, the weight average molecular weight (Mw) is $1\times10^4 \leqq Mw \leqq 4\times10^4$, the number average molecular weight (Mn) is $4\times10^3 \leqq Mn \leqq 2\times10^4$ and a ratio of the weight average molecular weight (Mw) to the number average molecular weight (Mn) is $Mw/Mn \leqq 5$. In case of $Mw<1\times10^4$, the softening point of the processed pigments is apt to be lower than 100° C. and desired styrene-acrylic resin domains are not fully formed in the toners. On the other hand, in case of $Mw>4\times10^4$, the softening point of the processed pigments is apt to exceed 150° C. and the desired styrene-acrylic resin domains are similarly not fully formed. Here, the styrene-acrylic resin domains are not present as a state dissolved in the polyester resins but are present as a dispersed state of the styrene-acrylic resin portion, while forming domain state. The phase separation structures of the colored toners were observed as follows. A sample was taken when it was sent out from the outlet of a header, followed by cooling and rolling. The sample was sliced by a microtome and observed by a transmission electron microscope. The styrene-acrylic resins hold phase separation structures forming discontinuous phase (hereinafter, referred to as domain) in the continuous phase which polyester resins form. The domain sizes are preferably 0.5 to 2.0 μm. The domain size is decided by the difference in viscosity of both resins when blended. The difference in melt viscosity at blending can be decreased by satisfying a relationship of $|T_2-T_3| \leqq 10°$ C., wherein $T_2$ is a softening point of the polyester resins and $T_3$ is a softening point of the processed pigments and the domain sizes of the styrene-acrylic resins can be adjusted to from 0.5 to 2.0 μm. In case of $|T_2-T_3|>10°$ C., the melt viscosity difference between resins becomes large and the domain sizes of the styrene-acrylic resins are apt to exceed 2.0 μm. When the domain sizes exceed 2.0 μm, the styrene-acrylic components are departed from the toner surfaces and selective melting proceeds, and fixing rollers are easily stained. On the other hand, when the domain sizes are less than 0.5 μm, the function of the styrene-acrylic resins is easily degraded, and offsetting phenomenon is likely caused. As a practical method to measure the domain, the cross sections of the toners are measured by a transmission type electron microscope. At the measurement, magnification of 2,500 times is preferably used. The cross sections of the toners are analyzed by an image analysis equipment and the Feret diameters are obtained for 100 domains. The arithmetic average of the diameters obtained is termed a domain diameter.

In the present invention, a domain size is defined as Feret diameter and the Feret diameter is a fixed direction diameter wherein a domain image is interpolated by two lines which are in parallel each other in a certain direction determined arbitrarily as shown in FIG. 1 so that both ends of the domain image come in contact with the two lines, and a distance between the two lines represents the domain size. In the present invention, the Feret diameter is measured as follows. One hundred domains are randomly selected, and each domain size is measured with a Scanning Electron Microscope (SEM) at a magnification of 2,500 times, and an average Feret diameter of the domains is defined as an average domain diameter of the present invention.

An addition amount of the pigments to the color toners is preferably from 2 to 10 parts in weight for 100 weight parts of the resins.

As colorants for the black toner, carbon blacks such as Channel Black are employed, Firmness Black, Acetylene Black, Thermal Black, Lamp Black, etc. The carbon blacks have good affinity with the resins as compared to the pigments. So, it is unnecessary to use commercial products wherein the carbon black is previously blended into resins.

An addition amount of the colorants to the black toner is preferably from 5 to 15 weight parts for 100 weight parts of resins. Releasing agents include polyolefin waxes such as low molecular weight polyethylene having a number average molecular weight of 1,500 to 10,000 (number average molecular weight is a molecular weight converted to polystyrene at high temperature GPC (gel permeation chromatography)), low molecular weight polypropylene, low molecular weight polyethylene-polypropylene copolymers with a number average molecular weight paraffin waxes with a high melting point such as microwax, Fischer-Tropsch wax, etc., ester waxes such as fatty acid lower alcohol esters, fatty acid higher alcohol esters, fatty acid polyhydric alcohol esters, etc., amide waxes and the like. These releasing agents can be used individually or in combination. Furthermore, low molecular weight polyethylene waxes having a number average molecular weight of 1,500 to 6,000 are preferably employed. An addition amount of the releasing agents is preferably from 2 to 10 weight parts for 100 weight parts of resins.

As other additives, charge control agents such as salicylic acid derivatives and azo type metal complexes can be mentioned.

In addition, as inorganic fine particles, silica, titanium oxide, aluminum oxide, barium titanate, strontium titanate and the like, with a number average primary particle diameter of 5 to 1,000 nm can be employed. These may undergo hydrophobic treatment. Hydrophobicity is preferably from 10 to 90 and more preferably from 30 to 80. In the present invention, the hydrophobicity is expressed as terms of methanol wetability. The methanol wettability is defined as the wetability for methanol as follows. Distilled water of 50 ml is placed in a 250 ml beaker and 0.2 g of inorganic fine particles is weighed and added. Methanol is with stirring slowly added while stirring from a burette of which outlet is immersed in the solution until all the inorganic fine particles are wet perfectly. The hydrophobicity is calculated by the following formula.

$$\text{Hydrophobicity}=[a/(a+50)]\times100$$

wherein a is methanol volume in ml necessary for making all the inorganic fine particles wet.

An addition amount of the inorganic fine particles is preferably 0.1 to 3.0 weight percent of colored particles.

Furthermore, to toners, as cleaning aids, styrene-acrylic resin fine particles having a number average primary particle size of 0.1 to 2.0 μm and higher fatty acid metal salts such as zinc stearate may be added.

A preferred addition amount of inorganic fine particles is 0.1 to 2.0 weight percent of colored particles. A preferred addition amount of the cleaning aids is about 0.01 to about 1.0 weight percent of the colored particles.

As carriers employed in two-component developers, either of resin-covered carriers wherein surfaces of magnetic particles such as iron, ferrite, magnetite, etc. are covered with resins or resin-dispersed type carriers which are obtainedby mixing resins with magnetic powders may be used. An average particle size of the carrier particles is preferably 30 to 150 μm in terms of the volume average particle size.

in addition, the present invention may be applied to non-magnetic single-component toners that are composed only of non-magnetic toners without using carriers.

In the toner image forming method of the present invention, conventionally known toner image forming methods can be applied.

When a toner image is transferred onto an image receiving material, (1) a transferring drum as disclosed in Denshi Shashin Gakkaishi, vol.28, No. 4, p.45 to 49 (1988), (2) an image carrying member as disclosed in Japan Hard Copy '89, p.163 (1989), and (3) a processing unit as disclosed in Japan Hard Copy '91, p.101 to 104 (1991) can be employed.

(2) Fixing Methods

A preferred fixing method employed in the present invention includes an upper roller having a heating source inside the metal cylinder which is composed of iron, aluminum, etc., of which surface is covered with silicone rubber of which surface is covered with tetrafluoroethylene, polytetrafluoroethylene-perfluoroalkoxy vinyl ether copolymers, etc. and a lower roller composed of silicone rubber of which surface is covered with tetrafluoroethylene, polytetrafluoroethylene-perfluoroalkoxyvinyl ether copolymers, etc. Specifically, the upper roller has a line heater as a heating source and the roller surface is heated to from 120° to 200° C.

At fixing, pressure is applied to the upper and lower rollers, and the lower roller is deformed so that so-called nip is formed. The nip width is usually 1 to 10 mm and preferably 3 to 7 mm. When the nip is small, uneven fixing is caused due to no supply of uniform heat to toner. On the other hand, when the nip width is large, the resin fusion is accelerated to cause excessive fixing offset.

A fixing line speed is preferably 10 to 200 mm/sec, though it depends on support media.

EXAMPLES

The present invention is now illustrated in more detail by reference to the following examples. However, the embodiments of the present invention are not limited thereto.

<<Examples of Preparation of Polyester Resins>>

According to the mixing ratios for raw materials in the following table, carboxlyic acids having at least two carboxyl group and dihydric/polyhydric alcohols were put into a reaction vessel equipped with a thermometer, a stirrer, a nitrogen gas supplying pipe and a condenser, heated in the presence of nitrogen gas, and reacted at 200° C. after the addition of a small amount of dibutyl tin oxide. During the initial reaction stage, it was controlled that raw materials with two functional groups only took part in the reaction. When dibutyl tin oxide was added, the raw materials having three functional or more groups were added. The reaction was terminated when intended chloroform-insoluble substances were obtained. In the following table, mixing ratios are expressed by weight.

TABLE 1

| Polyester | Softening Point | Carboxylic Acid* 3 Functional | Carboxylic Acid* 2 Functional | | Aliphatic Carboxylic Acid | Dihydric Aromatic Alcohol | Dihydric Aliphatic Alcohol | |
|---|---|---|---|---|---|---|---|---|
| Resin No. | (°C.) | TMA | TPA | FA | DKA | BPA | EG | NPG |
| Present Invention P-1 | 128 | 30 | 70 | 0 | 0 | 0 | 45 | 55 |
| Present Invention P-2 | 132 | 55 | 45 | 0 | 0 | 100 | 0 | 0 |
| Present Invention P-3 | 145 | 25 | 45 | 0 | 30 | 100 | 0 | 0 |
| Comparative P-4 | 95 | 0 | 0 | 100 | 0 | 100 | 0 | 0 |

Note: P-4 Polyester Resin is used as Comparative since it has no intermolecular crosslink structure.
Note: Unit of mixing ratios for Carboxylic Acid* and Polyhydric Alcohol is in weight part.
Note: Carboxylic acid* having at least two carboxyl group.
TMA: 1,2,4-benzenetricarboxylic acid
TPA: Terephthalic acid
FA: Fumaric acid
DKA: n-Dodecenylsuccinic acid
BPA: Polyoxypropylene(2,2)-2,2-bis(4'-hydroxyphenyl)propane
EG: Ethylene glycol
NPG: Neopentyl glycol <<Examples of Preparation of Styrene-Acrylic Resins>>

Preparation of Resin S-1 of Present Invention

| | |
|---|---|
| Styrene | 70 parts |
| n-Butylacrylate | 30 parts |

The styrene-acrylic resin S-1 was synthesized using the above monomers and mixing ratio. The resulting resin showed Mw=15,000, Mn=7,000, Mw/Mn=2.1 and softening point of 100° C.

Preparation of Resin S-2 of Present Invention

| | |
|---|---|
| Styrene | 65 parts |
| n-Butylmethacrylate | 35 parts |

The styrene-acrylic resin S-2 was synthesized using the above monomers and mixing ratio. The resulting resin had Mw=25,000, Mn=10,000, Mw/Mn=2.5 and softening point of 112° C.

Preparation of Resin S-3 for Comparative

| | |
|---|---|
| Styrene | 80 parts |
| n-Butylacrylate | 20 parts |

The resin S-3 was synthesized using the above monomers and mixing ratio. The resulting resin showed Mw=8,000, Mn=4,500, Mw/Mn=1.8 and softening point of 88° C.

Preparation of Resin S-4 for Comparative

| | |
|---|---|
| Styrene | 65 parts |
| n-Butylacrylate | 35 parts |

The styrene-acryl resin S-4 was synthesized using the above monomers and mixing ratio. The resulting resin had Mw=120,000, Mn=16,000, Mw/Mn=7.5 and softening point of 125° C.

<<Examples of Preparation of Processed Pigments>>

Yellow Processed Pigment Y-1:

| | |
|---|---|
| Styrene-acrylic resin S-1 | 60 parts |
| C.I. Pigment Yellow 17 | 40 parts |

The above mixture was placed in a kneader type blending machine and was blended for 30 minutes at 120° C. After cooling, the resulting mixture was melt blended by three heated rolls, followed by cooling and pulverization. The yellow processed pigment with a softening point of 130° C. was obtained.

Yellow Processed Pigment Y-2:

| | |
|---|---|
| Styrene-acrylic resin S-3 | 55 parts |
| C.I. Pigment Yellow 12 | 45 parts |

The above mixture was fed to a kneader type blending machine and melt blended for 30 minutes at 100° C. After cooling the mixture was blended by three heated rolls, followed by cooling and pulverization. The yellow processed pigment with a softening point of 102° C. was obtained.

Magenta Processed Pigment M-1:

| | |
|---|---|
| Styrene-acrylic resin S-2 | 70 parts |
| C.I. Pigment Red 122 | 30 parts |

The above mixture was mixed by a Henschel mixer and melt and blended by a 2 axial extruder, followed by cooling and pulverization. The magenta processed pigment with a softening point of 123° C. was obtained.

Magenta Processed Pigment M-2:

| | |
|---|---|
| Styrene-acrylic resin S-4 | 70 parts |
| C.I. Pigment Red 57:2 | 30 parts |

The above mixture was mixed by a Henschel mixer, and melt blended by a 2 axial extruder, followed by cooling and pulverization. The magenta processed pigment with a softening point of 144° C. was obtained.

Cyan Processed Pigment C-1:

| | |
|---|---|
| Styrene-acrylic resin S-1 | 55 parts |
| C.I. Pigment Blue 15:3 | 45 parts |

The above mixture was introduced into a header type blending machine and blended for 20 minutes at 130° C., followed by cooling and pulverization. The cyan processed pigment with a softening point of 139° C. was obtained.

Cyan Processed Pigment C-2:

| | |
|---|---|
| Styrene-acrylic resin S-2 | 60 parts |
| C.I. Pigment Blue 15:3 | 40 parts |

The above mixture was placed in a header type blending machine and blended for 20 minutes at 130° C., followed by cooling and pulverization. The cyan processed pigment with a softening point of 122° C. was obtained.

The aforementioned polyester resin, processed pigment or carbon black and releasing agent were mixed under the mixing ratio shown in Table 2 and melt blended, followed by pulverization and classification. The colored particles with a volume average particle size of 8.5 μm were obtained.

The surface tension of the styrene-acrylic resins is 20 to 28 mN/m (200° C.) as described in Polymer Handbook, Third Edition, 1989, A. Wiley-Interscience Publication: VI pages 411 to 432, while the surface tension of the polyester resins is 30 to 35 mN/m (200° C.). The surface tension of polytetrafluoroethylene-perfluoroalkoxyvinyl ether copolymers is about 13 mN/m (200° C.). Since the polyester resins have good affinity to fixing rollers, the polyester resin is easily adhered to the fixing rollers and are apt to cause offsetting. From a standpoint of the affinity to the fixing rollers, the styrene-acrylic resins are preferable for the toner resins, but from a standpoint of tribo-electrification property, are apt to cause electrostatic offsetting between fixing rollers because it is positively charged. Therefore, the mixing ratios of the styrene-acrylic resins to the polyester resins are preferably 5 to 25 weight parts of 100 weight parts of polyester resins. When the mixing ratios of the styrene-acrylic resins are less than 5 weight parts, offsetting is caused since the toners carry good affinity to the fixing rollers. On the other hand, when the mixing ratios of the styrene-acrylic resins exceed 25 weight parts, electrostatic offsetting is easily caused since the toners are charged excessively to a plus side.

On the other hand, the softening point of the colored toners can be specified to be lower than that of the black toner by increasing the shearing force during blending as compared to the black toner. The increase in the shearing force is well known in the art. There may be available any of methods such as an increase in a feeding amount to a blending machine, change of a screw of a blending machine and an increase in residence time.

In addition, developers with a toner concentration of 7 weight percent were prepared by mixing these toners with ferrite carrier particles with a volume average particle size of 62 μm which are covered by the styrene-acrylic resins.

Fixing Conditions of Heat Rollers

A heat roller method comprises an upper roller made of an aluminum cylinder covered by silicone rubber of a thickness 1.0 mm of which surface is covered by a tetrafluoroethylene-perfluoroalkyl vinyl ether copolymers, in which a heater of 30 mm in diameter is installed at the center and a lower roller of 30 mm in diameter of which surface is covered by the silicone rubber of thickness 1.0 mm of which surface is similarly covered by the tetrafluoroethylene-perfluoroalkylether copolymers. The pressing pressure was set at 7N/cm and the nip width was adjusted to 4.0 mm. With use of this fixing unit, the line speed for fixing paper was set at 100 mm/sec and at fixing transparency for OHP was set at 20 mm/sec.

TABLE 2

| Kit No. | Color | Resin (Softening point) | Pigment or Colorant (Softening* Point) | Domain Diameter | Toner Softening Point |
|---|---|---|---|---|---|
| Example (1) | Y | P-1:100 128° C. | Y-1:20 130° C. | 0.7 μm | 122° C. |
| | M | P-1:100 128° C. | M-1:20 123° C. | 0.9 μm | 124° C. |
| | C | P-1:100 128° C. | C-2:10 122° C. | 0.8 μm | 122° C. |
| | K | P-1:100 128° C. | Carbon Black: 8 | — | 128° C. |
| Example (2) | Y | P-2:100 132° C. | Y-1:18 130° C. | 1.7 μm | 121° C. |
| | M | P-2:100 132° C. | M-1:19 123° C. | 1.6 μm | 124° C. |
| | C | P-2:100 132° C. | C-2: 9 122° C. | 1.2 μm | 122° C. |
| | K | P-2:100 132° C. | Carbon Black: 10 | — | 124° C. |
| Comparative Example (1) | Y | P-3:100 145° C. | Y-1:16 130° C. | 2.3 μm | 140° C. |
| | M | P-3:100 145° C. | M-1:17 123° C. | 3.1 μm | 138° C. |
| | C | P-3:100 145° C. | C-2: 9 122° C. | 2.8 μm | 138° C. |
| | K | P-3:100 145° C. | Carbon Black: 10 | — | 142° C. |
| Comparative Example (2) | Y | P-4:100 95° C. | Y-1:14 130° C. | 3.6 μm | 98° C. |
| | M | P-4:100 95° C. | M-1:15 123° C. | 3.1 μm | 100° C. |
| | C | P-4:100 95° C. | C-1: 9 139° C. | 4.2 μm | 99° C. |
| | K | P-4:100 95° C. | Carbon Black: 7 | — | 95° C. |
| Comparative Example (3) | Y | P-1:100 128° C. | Y-2:20 102° C. | 3.3 μm | 122° C. |
| | M | P-1:100 128° C. | M-2:20 144° C. | 2.8 μm | 124° C. |
| | C | P-1:100 128° C. | C-1:11 139° C. | 2.5 μm | 122° C. |
| | K | P-1:100 128° C. | Carbon Black: 8 | — | 127° C. |
| Comparative Example (4) | Y | P-1:100 128° C. | Y-1:20 130° C. | 0.3 μm | 122° C. |
| | M | P-1:100 128° C. | M-1:20 123° C. | 0.2 μm | 124° C. |
| | C | P-1:100 128° C. | C-2:11 122° C. | 0.2 μm | 122° C. |
| | K | P-1:100 128° C. | Carbon Black: 8 | — | 128° C. |
| Comparative Example (5) | Y | P-1:100 128° C. | C.I.P.Y. 17 :8 | — | 125° C. |
| | M | P-1:100 128° C. | C.I.P.R. 122 :8 | — | 122° C. |
| | C | P-1:100 128° C. | C.I.P.B. 15:3:4 | — | 123° C. |
| | K | P-1:100 128° C. | Carbon Black: 8 | — | 126° C. |
| Comparative Example (6) | Y | P-1:100 128° C. | Y-1:20 130° C. | 0.7 μm | 122° C. |
| | M | P-1:100 128° C. | M-1:20 123° C. | 0.9 μm | 124° C. |
| | C | P-1:100 128° C. | C-2:12 122° C. | 0.9 μm | 122° C. |
| | K | P-1:100 128° C. | Carbon Black: 8 | — | 118° C. |

Note: Units of mixing ratios for resins and colorants are in weight parts.
Note: Softening point is a softening temperature of processed pigment.
Note 1: To every toner, are optionally added 3 parts of low molecular weight polyolefin wax and 4 parts of ethylenebisamide wax in the extra process.
Note 2: Comparative Examples (1) and (3) satisfy a relationship of $|T_2 - T_3| > 10°$ C.

Comparative Example (2) uses non-crosslinked polyester resin.

Comparative Example (4) uses a compatibilizer.

Comparative Example (5) uses a raw pigment.

Comparative Example (6) comprises black toner with a lower softening point than that of colored toners.

Evaluation Machine

For the evaluation, a copying machine U-BIX 1017 manufactured by Konica Corporation was modified and used. The modifications regarding fixing conditions are as follows.

<<Evaluation>>

Evaluation of Image Glossiness of Paper

A solid image was developed with the above-described developer and fixed onto a sheet of XEROX 4024 20-pound paper. The glossiness of the image was measured by a variable angle glossmeter VGS-1D (manufactured by Nihon Denshoku Kogyo Co., Ltd.) at an angle of 75° for incidence and acceptance, respectively. The gloss is preferably not more than 15 percent, since the gloss exceeding 15 percent makes the image glittering.

Evaluation of OHP transparency

A solid image was developed with the above-described developer and fixed onto a sheet of CG3300, 5 milOHT manufactured by 3M Ltd. The transmission rate of the image was measured by an automatic recording spectrophotometer U-3500 (manufactured by Hitachi, Ltd.) at the wavelength of 600 nm for a yellow toner, 630 nm for a magenta toner and 500 nm for a cyan toner, respectively, at which each of colored toners has been found to have the maximum spectral reflectance. When the transmission rate is less than 40 percent, the transmitted image is dark, and letters and characters are not easily read. When the transmission rate is not less than 40 percent and less than 60 percent, a relatively bright image is obtained but the transparency is not enough. Specifically, when an image with multi colors is formed, the image looks dark. When the transmission rate is not less than 60 percent, the transparency is sufficient for the image with multi colors and the bright and sharp transmitted image can be obtained.

Evaluation as to Winding Property

A solid image was developed with the above-described developer and fixed onto a sheet of JAMESTOWN BOND, 16-pound paper while changing an amount of the toner transferred to the paper and fixed. The winding property is evaluated as a maximum toner adsorbed amount (M/Amax) to the paper at the time when no paper winding to a fixing roller occurs during passing the paper through the fixing unit hold at 160° C. M/Amax≦0.6 mg/cm$^2$ indicates lower level than that for practical use. A range of 0.6 mg/cm$^2$<M/Amax≦0.8 mg/cm$^2$ shows that winding occurs for overlapped multicolor developed image portion of the image with multi colors. M/Amax>0.8 mg/cm$^2$ signifies that no winding phenomenon occurs.

Evaluation of Roller Stain

The roller stain was measured as follows. The fixing unit was held at 180° C. and a coating amount of silicone oil was set at 0.5 mg per sheet of paper in A4 size. Then, 2,000 sheets of paper having an image of black area ratio of 9 percent of the total area were processed. The roller stain was evaluated by the following 3 criteria. "A" represents no stain on rollers, "B" partial stain on rollers, "C" stain on the whole area of rollers, and "D" marked stain on the whole area of rollers.

Results obtained in the above section are shown in Table 3.

TABLE 3

| Kit No. | | Gloss | OHP Transmittance | Winding | Roller Stain |
|---|---|---|---|---|---|
| Example (1) | Y | 7% | 63% T | 1.0/mg or more | A |
| | M | 7% | 66% T | 1.1 | A |
| | C | 8% | 72% T | 1.0 | A |
| | K | 8% | — | 1.3 | A |
| Example (2) | Y | 8% | 70% T | 1.1 | A |
| | M | 10% | 72% T | 0.9 | A |
| | C | 10% | 70% T | 1.2 | A |
| | K | 9% | — | 1.3 | A |
| Comparative Example (1) | Y | 5% | 55% T | 0.7 | B |
| | M | 5% | 60% T | 0.6 | B |
| | C | 5% | 57% T | 0.7 | B |
| | K | 4% | — | 1.2 | A |
| Comparative Example (2) | Y | 31% | 82% T | 0.5 | D |
| | M | 35% | 78% T | 0.5 | D |
| | C | 34% | 85% T | 0.6 | D |
| | K | 33% | — | 0.5 | D |

TABLE 3-continued

| Kit No. | | Gloss | OHP Transmittance | Winding | Roller Stain |
|---|---|---|---|---|---|
| Comparative Example (3) | Y | 7% | 56% T | 0.6 | B |
| | M | 7% | 52% T | 0.7 | B |
| | C | 6% | 52% T | 0.7 | B |
| | K | 4% | — | 1.2 | A |
| Comparative Example (4) | Y | 8% | 71% T | 1.0 | B |
| | M | 10% | 66% T | 0.9 | B |
| | C | 10% | 65% T | 1.0 | B |
| | K | 10% | — | 1.3 | A |
| Comparative Example (5) | Y | 7% | 51% T | 0.6 | C |
| | M | 10% | 46% T | 0.4 | C |
| | C | 9% | 47% T | 0.5 | C |
| | K | 10% | — | 1.3 | A |
| Comparative Example (6) | Y | 12% | 66% T | 1.0 | A |
| | M | 15% | 70% T | 1.1 | A |
| | C | 13% | 70% T | 1.1 | A |
| | K | 21% | — | 0.9 | B |

Practical usable ranges are as follows:

The degree of glossiness: 15% or less

The OHP transmission rate: 60% T or more

Winding: 0.8 mg/cm$^2$ or more

Roller stain: A

As apparent from Table 3, when a multi color toner kit having a constitution of the present invention is employed, an excellent multi color image in which the OHP transmission rate is improved can be obtained and releasing performance of a toner to the fixing roller is improved while controlling image glossiness, so that roller stain can noticeably be improved and durability performance of the machine is also improved.

What is claimed is:

1. A toner kit for an electrophotography, comprising a black toner and a first toner whose color is other than black, wherein said first toner has a first softening point $T_1$, said first toner comprises a first releasing agent, a first intermolecular crosslinked polyester resin having a second softening point $T_2$ of 100° C. to 150° C. obtained by a reaction of an alcohol having at least two hydroxyl group and a carboxylic acid having at least two carboxyl group and a processed pigment having a third softening point $T_3$ of 100° C. to 150° C., said processed pigment comprising a pigment and a binder resin in which said pigment is dispersed, and said binder resin forms domain structure in said first polyester resin, and wherein said black toner has a fourth softening point $T_4$, said black toner comprises a second releasing agent, a colorant and a second intermolecular crosslinked polyester resin having a fifth softening point $T_5$ of 100° C. to 150° C., obtained by a reaction of an alcohol having at least two hydroxyl group and a carboxylic acid having at least two carboxyl group, and wherein said fourth softening point $T_4$ is not less than said first softening point $T_1$.

2. The toner kit of claim 1, wherein said binder resin is a styrene-acrylic resin.

3. The toner kit of claim 1, wherein said domain structure has a domain size of 0.5 to 2.0 μm in said first polyester resin.

4. The toner kit of claim 1, wherein said $T_2$ and said $T_3$ satisfy the following Formula 1:

Formula 1

$|R_2-T_3| \leqq 10°$ C.

5. The toner kit of claim 1, wherein said toner other than said black toner and said black toner each has a volume average particle size of 1 to 30 μm.

6. The toner kit of claim 1, wherein said first toner and said black toner each has a volume average particle size of 5 to 15 μm.

7. The toner kit of claim 1, wherein said pigment is contained in an amount of not less than 30% and of less than 50% by weight of said binder resin.

8. The toner kit of claim 2, wherein said styrene-acrylic resin has a weight average molecular weight (Mw) of 10,000 to 40,000, a number average molecular weight (Mn) of 4,000 to 20,000 and a ratio of said weight average molecular weight (Mw) to said number average molecular weight (Mn) is not more than 5.

9. The toner kit of claim 1, wherein said colorant is a carbon black.

10. The toner kit of claim 1, wherein said colorant is selected from carbon black group consisting of Channel Black, Firmness Black, Acetylene Black, Thermal Black and Lamp Black.

11. The toner kit of claim 1, wherein said second releasing agent is a low molecular weight polyethylene having a number average molecular weight of 1,500 to 10,000.

12. The toner kit of claim 1, wherein said second releasing agent is a low molecular weight polyethylene having a number average molecular weight of 1,500 to 6,000.

13. The toner kit of claim 1, wherein at least one of said black toner and said toner other than said black toner contains inorganic fine particles selected from a group consisting of silica, titanium oxide, aluminum oxide, barium titanate and strontium titanate.

14. The toner kit of claim 13, wherein said inorganic fine particles have a hydrophobicity of 10 to 90 in terms of methanol wetability.

15. The toner kit of claim 13, wherein said inorganic fine particles have a hydrophobicity of 30 to 80 in terms of methanol wetability.

16. A toner image forming method, comprising steps of:

(1) forming a first latent image on an image carrying member, (2) developing said first latent image with a first toner whose color is other than black, (3) forming a second latent image on an image carrying member, and (3) developing said second latent image with a black toner, wherein said first toner has a first softening point $T_1$, said first toner comprises a first releasing agent, a first intermolecular crosslinked polyester resin having a second softening point $T_2$ of 100° C. to 150° C. obtained by a reaction of an alcohol having at least two hydroxyl group and a carboxylic acid having at least two carboxyl group and a processed pigment having a third softening point $T_3$ of 100° C. to 150° C., said processed pigment comprising a pigment and a binder resin in which said pigment is dispersed, and said binder resin forms domain structure in said first polyester resin, and wherein said black toner has a fourth softening point $T_4$, said black toner comprises a second releasing agent, a colorant and a second intermolecular crosslinked polyester resin having a fifth softening point $T_5$ of 100° C. to 150° C. obtained by a reaction of an alcohol having at least two hydroxyl group and a carboxylic acid having at least two carboxyl group, and wherein said fourth softening point T4 is not less than said first softening point $T_1$.

17. The toner image forming method of claim 16, wherein said first toner is a toner selected from the group consisting of a yellow toner, a magenta toner and a cyan toner.

* * * * *